US006523545B2

(12) United States Patent
Rende

(10) Patent No.: US 6,523,545 B2
(45) Date of Patent: Feb. 25, 2003

(54) DEVICE FOR RETAINING NAIL CLIPPINGS IN A NAIL CLIPPER

(76) Inventor: Vincent N. Rende, 42 Water St., Eastchester, NY (US) 10709

( * ) Notice: Subject to any disclaimer, the term of this patent is extended or adjusted under 35 U.S.C. 154(b) by 0 days.

(21) Appl. No.: 10/047,173

(22) Filed: Jan. 14, 2002

(65) Prior Publication Data

US 2003/0010349 A1 Jan. 16, 2003

Related U.S. Application Data

(60) Provisional application No. 60/305,594, filed on Jul. 16, 2001.

(51) Int. Cl.[7] ..... A45D 29/18; B26B 13/22

(52) U.S. Cl. ..... 132/75.5; 30/28; 30/124

(58) Field of Search ..... 132/75, 75.4, 75.5; 30/26, 27, 28, 124, 125

(56) References Cited

U.S. PATENT DOCUMENTS

| | | | | | |
|---|---|---|---|---|---|
| 3,188,737 | A | * | 6/1965 | Chase | 30/124 |
| 4,219,929 | A | | 9/1980 | Min | 30/28 |
| 4,640,011 | A | | 2/1987 | Gamble | 30/28 |
| 4,996,771 | A | | 3/1991 | Williams | 30/28 |
| 5,010,644 | A | | 4/1991 | Goench | 30/28 |
| 5,077,511 | A | * | 12/1991 | Ro | 30/28 |
| 5,131,146 | A | | 7/1992 | Leininger | 30/28 |
| 5,195,544 | A | | 3/1993 | Campagna | 132/75.5 |
| 5,524,344 | A | * | 6/1996 | Bazal | 30/28 |
| 5,564,189 | A | | 10/1996 | Lee | 30/29 |
| 5,632,288 | A | * | 5/1997 | Webb | 132/75.5 |
| 6,009,880 | A | * | 1/2000 | Weidlich | 132/75.4 |
| 6,220,251 | B1 | * | 4/2001 | Jeong et al. | 132/73.5 |

* cited by examiner

*Primary Examiner*—Todd E. Manahan
(74) *Attorney, Agent, or Firm*—Milde & Hoffberg, LLP

(57) ABSTRACT

A device for retaining nail clippings within a nail clipper includes a housing adapted to cover the openings between the clippers elongate members, on both sides, from the first ends to the second ends thereof, thereby forming an enclosed region within the nail clipper. In addition, the device includes a valve element, adapted to be located between the elongate members, for blocking the passage of the nail clippings from the region of the jaw to the tail of the nail clipper when the jaw is opened and for allowing passage of the nail clippings when the jaw is closed. This allows nail clippings to pass to the region between the elongate members when the nails are being clipped and thereafter to be retained in this region when the jaw is opened. Thus, in effect, the valve works as a one way valve, permitting passage of the nail clippings into, but not out of, the nail clipper.

15 Claims, 6 Drawing Sheets

DEVICE FOR RETAINING NAIL CLIPPINGS IN A NAIL CLIPPER

CROSS-REFERENCE TO RELATED APPLICATION

This application claims priority from Provisional Patent Application Ser. No. 60/305,594 filed Jul. 16, 2001 and entitled "MECHANICAL SPRING LOADED UNIDIRECTIONAL MECHANICAL VALVE (MSLUV) UTILIZED IN A NAIL CLIPPER".

BACKGROUND OF THE INVENTION

The present invention relates to a device for retaining nail clippings which are cut by a conventional nail clipper.

More particularly, the present invention relates to a device for retaining nail clippings which are cut by a nail clipper of the type disclosed in the U.S. Pat. No. 4,640,011. This nail clipper comprises two substantially similar, spring like elongate members, each having a first end forming a transverse cutting edge and a second, opposite end. The second ends of the elongate members are affixed together such that the cutting edges at the first ends are normally spaced apart but can be pressed into cutting engagement against the natural spring bias of the elongate members. The nail clipper further comprises a pin arranged to pass through a hole in the each of the elongate members in the vicinity of the cutting edges at the first ends thereof. The pin has a head at one end which is larger than the hole of the adjacent elongate member, thus anchoring the pin at this one end, and has a pivot attachment at its opposite end. A lever arm is pivotily attached to this opposite end of the pin and is operative to swivel between a first position, in which the cutting edges of the elongate members remain spaced apart, and a second position, in which the elongate members are pressed together and their respective cutting edges are pressed into cutting engagement.

When nail clippers of this type are used, the clippings obtained from a fingernail or toenail tend to fall or even jump out and drop onto the floor, creating an unsightly and unhealthy mess. To remedy this problem, various means have been devised to catch the nail clippings within the confines of the nail clipper; that is, within the space between the two elongate members. The following U.S. Patents disclose various types of such "catching devices":

U.S. Pat. No. 4,219,929
U.S. Pat. No. 4,640,011
U.S. Pat. No. 4,996,771
U.S. Pat. No. 5,010,644
U.S. Pat. No. 5,131,146
U.S. Pat. No. 5,195,544
U.S. Pat. No. 5,564,189

These devices are essentially similar in that they all provide means for preventing nail clippings from exiting the open side regions between the two elongate members. Consequently, these devices are essentially tubular in shape and are designed to slide over the elongate members and cover the side regions between these members.

These devices for catching the nail clippings are quite effective but are all subject to one major defect: the nail clippings can eject through the open jaw of the nail clipper between the cutting edges when the nail clipper is vertically oriented with the jaw is pointing downward.

SUMMARY OF THE INVENTION

It is a principal object of the present invention to provide a device for retaining nail clippings which are cut by a nail clipper of the type described above.

It is a further, more specific object of the present invention, to provide a device for retaining nail clippings which are cut by a nail clipper of the type described above and which is effective to retain the nail clippings no matter how the nail clipper may be oriented.

These objects, as well as further objects which will become apparent from the discussion that follows, are achieved, in accordance with the present invention, by providing a device which, like the prior devices, includes a housing adapted to cover the openings between the elongate members, on both sides, from the first ends to the second ends thereof, thereby forming an enclosed region within the nail clipper. In addition, the device according to the present invention includes a valve element, adapted to be located between the elongate members, for blocking the passage of the nail clippings from the region of the jaw to the tail of the nail clipper when the jaw is opened and for allowing passage of the nail clippings when the jaw is closed. This allows nail clippings to pass to the region between the elongate members when the,nails are being clipped and thereafter to be retained in this region when the jaw is opened.

Thus, in effect, the valve works as a one way valve, permitting passage of the nail clippings into, but not out of, the nail clipper.

Advantageously, the housing is made of plastic, such as clear plastic, and has a U-shaped profile in the region surrounding the valve element. From the position of the valve element to the back section or tail of the nail clipper, the housing has an open triangle shape. This arrangement squeezes the plastic against the lateral edges of the top elongate member so that the nail clippings cannot escape out the top. The bottom of housing is wider, permitting the clippings to overflow in the housing. Foam or felt seals placed in the front and rear of the housing prevent the collected clippings from escaping from the front and rear of the nail clipper.

External surfaces of the housing may be provided with text and/or graphics, for example to serve as advertising.

Advantageously, the housing can be designed to pivot about side pins which extend laterally outward from the valve element. This arrangement makes it extremely convenient to open the housing and remove the clippings.

As an added feature, the housing may incorporate an electric light, with a battery, switch and series electric circuit to operate the light. The device according to the invention thus doubles as a small pen light.

The valve element in the device according to the present invention is preferably of tubular shape, adapted to surround the elongate member which is adjacent to the lever arm. This tubular shaped element pivots between a closed position, preventing passage of the nail clippings, when the lever arm of the nail clipper is in its first position and the cutting jaw is open, and an open position permitting passage of the nail clippings when the lever arm is in its second position and the jaw is closed.

Preferably, this valve element further comprises a spring member, which extends as a projection from the tubular shaped element and presses against the elongate member which is adjacent the lever arm, to bias the valve element into its closed position.

The tubular member is preferably made of clear plastic, as is the housing, so that the nail clippings stored within the nail clipper are visible. Perhaps even more importantly, the clear plastic valve element allows the finger nail to be visible from the side when it is placed between the cutting edges of the nail clipper jaw. With a non-clear housing it is difficult to align the finger nail between the cutting edges.

The operation of the valve element is enhanced if resilient material, such as felt or foam, is disposed on at least one of the elongate members to engage the contact surfaces of the tubular valve element.

Finally, to facilitate the passage of nail clippings around the central pin in the vicinity of the jaw, the pin is provided with a V-shaped profile, with the apex of the V pointed toward the jaw.

For a full understanding of the present invention, reference should now be made to the following detailed description of the preferred embodiment of the invention as illustrated in the accompanying drawings.

DETAILED DESCRIPTION OF THE PREFERRED EMBODIMENT

Figure 1:
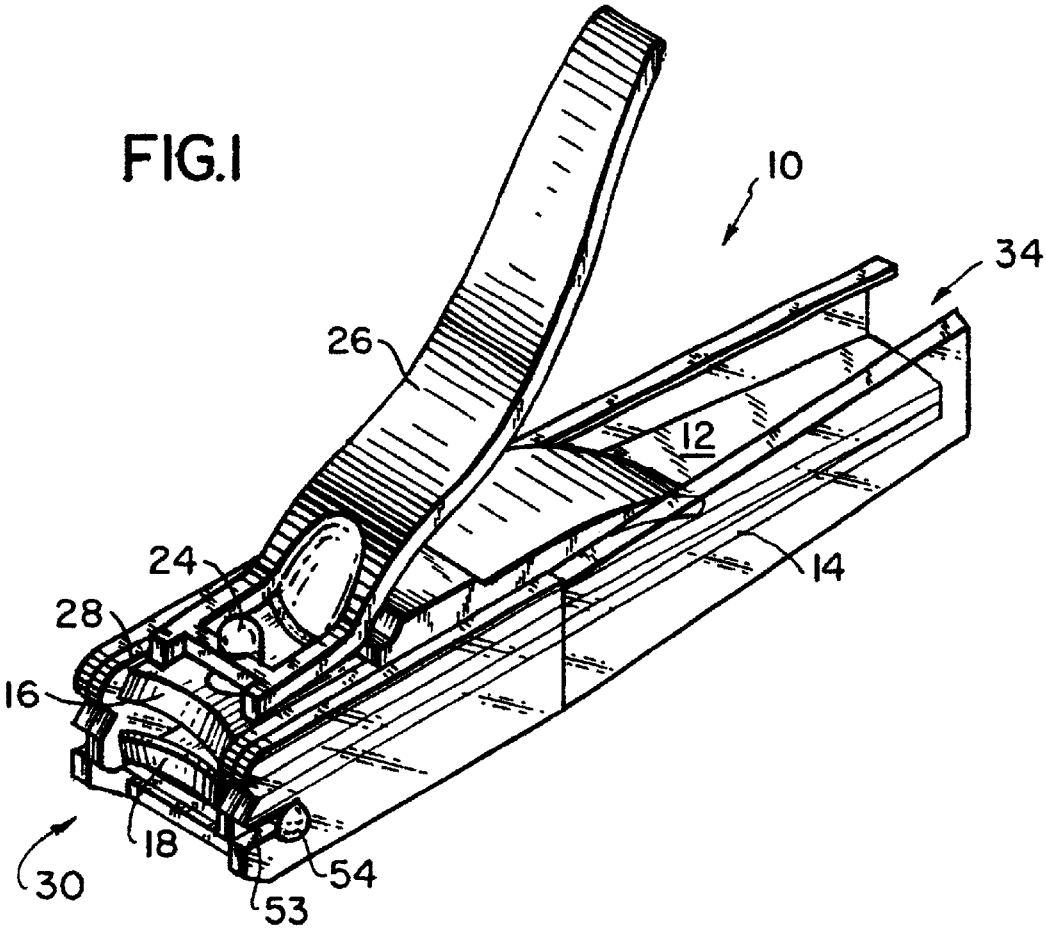
FIG. 1 is a perspective view of a nail clipper which incorporates a preferred embodiment of the device according to the invention for retaining nail clippings within it.

The preferred embodiment of the present invention will now be described with reference to FIGS. 1–8 of the drawings. Identical elements in the various figures are identified with the same reference numerals.

FIG. 1 shows a conventional nail clipper 10 which is provided with a device for retaining the cut nail clippings. The nail clipper itself comprises four separate elements.

Two substantially similar, spring-like elongate members 12 and 14 each have a first end forming a transverse cutting edge 16 and 18, respectively, and a second, opposite free end 20 and 22, respectively. The ends with the cutting edges 16, 18 form a jaw30; the opposite ends 20, 22, which are affixed together by a bolt, rivet, or the like (not shown), form a tail 34 of the nail clipper.

A pin 24 passes through holes in the elongate members (not shown) which are located near the jaw. This pin is pivotly attached to a lever arm 26 that is operative to swivel between a first position (shown in FIG. 1) in which the cutting edges of the elongate members remain spaced apart (i.e., the jaw is open) and a second position (not shown) in which the elongate members are pressed together against their natural spring bias so that their respective cutting edges are pressed into cutting engagement (i.e., the jaw is closed).

The device according to the present invention comprises a housing 26 which is adapted to cover the openings between the elongate members on the opposite, lateral edges thereof. This forms an enclosed region for the nail clippings from the jaw to the tail of the nail clipper.

In addition, the device according to the invention, includes a valve element 28, adapted to be arranged between the elongate members, for blocking passage of the nail clippings when the lever arm is in its first position (the position shown in FIG. 1) and for allowing passage of the nail clippings when the lever arm is in the aforementioned second position (not shown). This valve element allows the nail clippings to pass from the region of the jaw, where they are cut, to the tail region between the elongate members when the cutting edges are pressed together and thereafter to retain these nail clippings in this "tail" region when the cutting edges are spaced apart. Due to the open triangle shape in the rear portion of the housing, the clippings are able to also collect in the space of the housing below the lower elongate member.

Figure 2A:
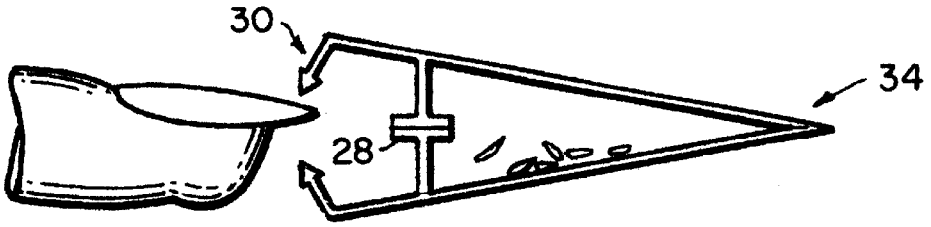
FIGS. 2A, 2B and 2C are representational diagrams of a nail clipper containing a valve element which either blocks or allows passage of nail clippings from one end of the nail clipper to the other.
Figure 2B:
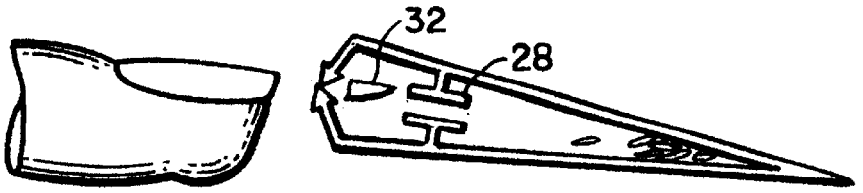
Figure 2C:
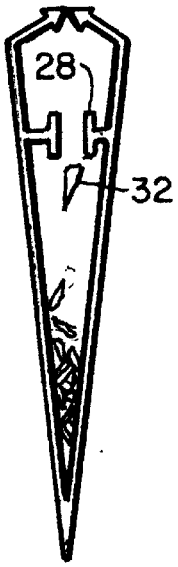

FIG. 2 illustrates the operation of the retaining device according to the present invention. As shown in FIG. 2A, the valve element 28 is normally closed when the jaw 30 is open. As shown in FIG. 2B, the valve 28 is open when the jaw 30 is closed. This allows the nail clippings 32 to pass from the jaw region 30 of the nail clipper to the tail region 34 when the nail clipper is tipped upward in the manner shown in FIG. 2C.

Figure 3A:
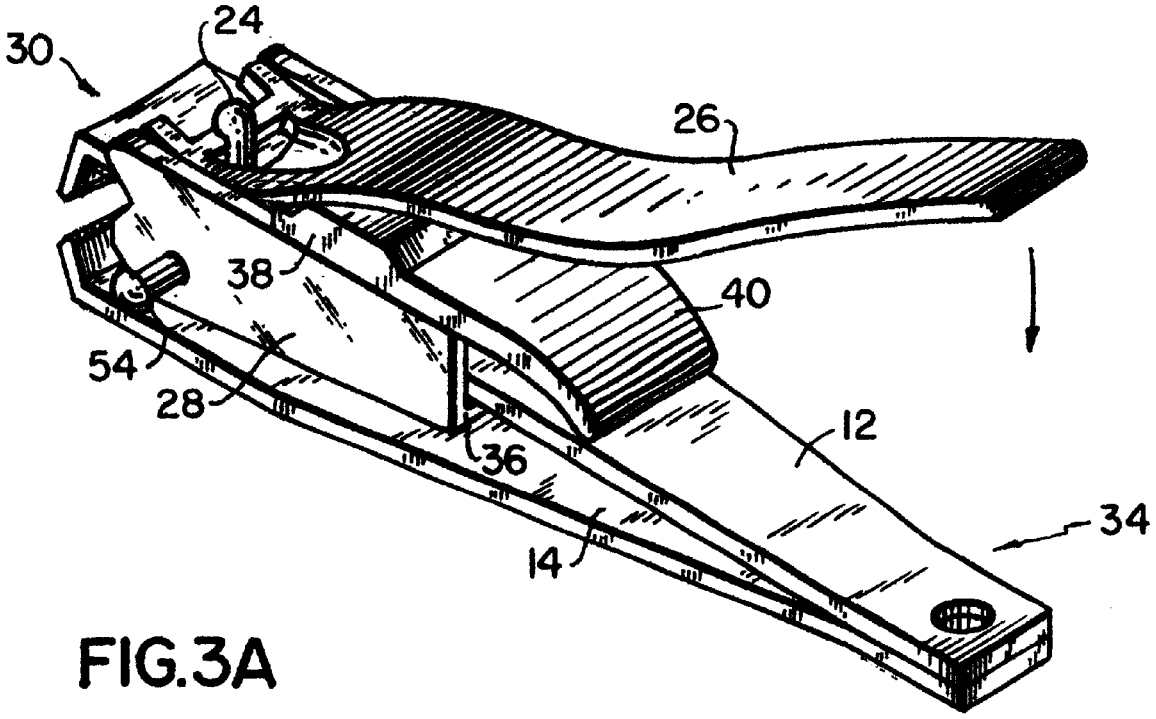
FIGS. 3A and 3B are perspective views of a nail clipper and retaining device, according to the invention, with the valve element in the closed and open positions, respectively.
Figure 3B:
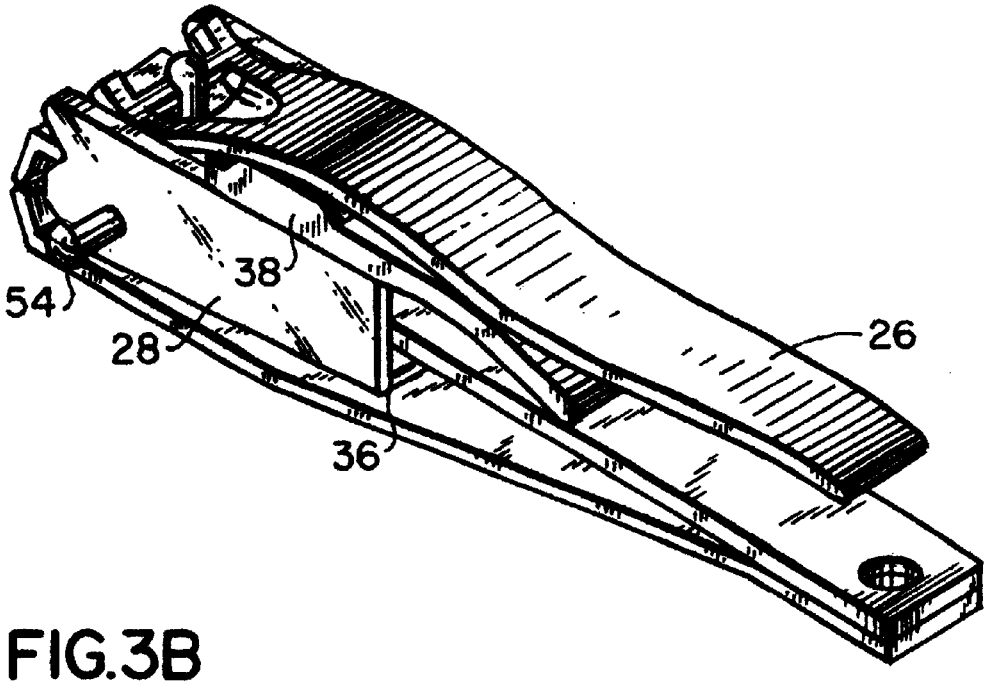

FIGS. 3A and 3B illustrate how the valve element 28 operates (1) to hold itself closed when the jaw 30 is open and (2) to open itself when the jaw 30 is closed. In FIGS. 3A and 3B, the surrounding housing 26 has been removed for clarity.

As seen in FIG. 3A, the bottom edge 36 of the tubular-shaped valve element 28 is pressed against the lower surface of the elongate element 12, preventing any nail clippings from passing this point from the jaw 30 to tail 34 of the nail clipper, or vice versa. In FIG. 3B, the bottom edge 36 of the valve element 28 is spaced apart from the elongate member 12 so that nail clippings can pass through. As may be seen in FIG. 3B, the valve element 28 is moved downward by pressure applied by the lever arm 26 against a projection 38 at the top of the valve element. The valve element 28 is biased upwardly by means of a tongue 40 that presses against the elongate member 12 and acts as a spring.

Figure 4:
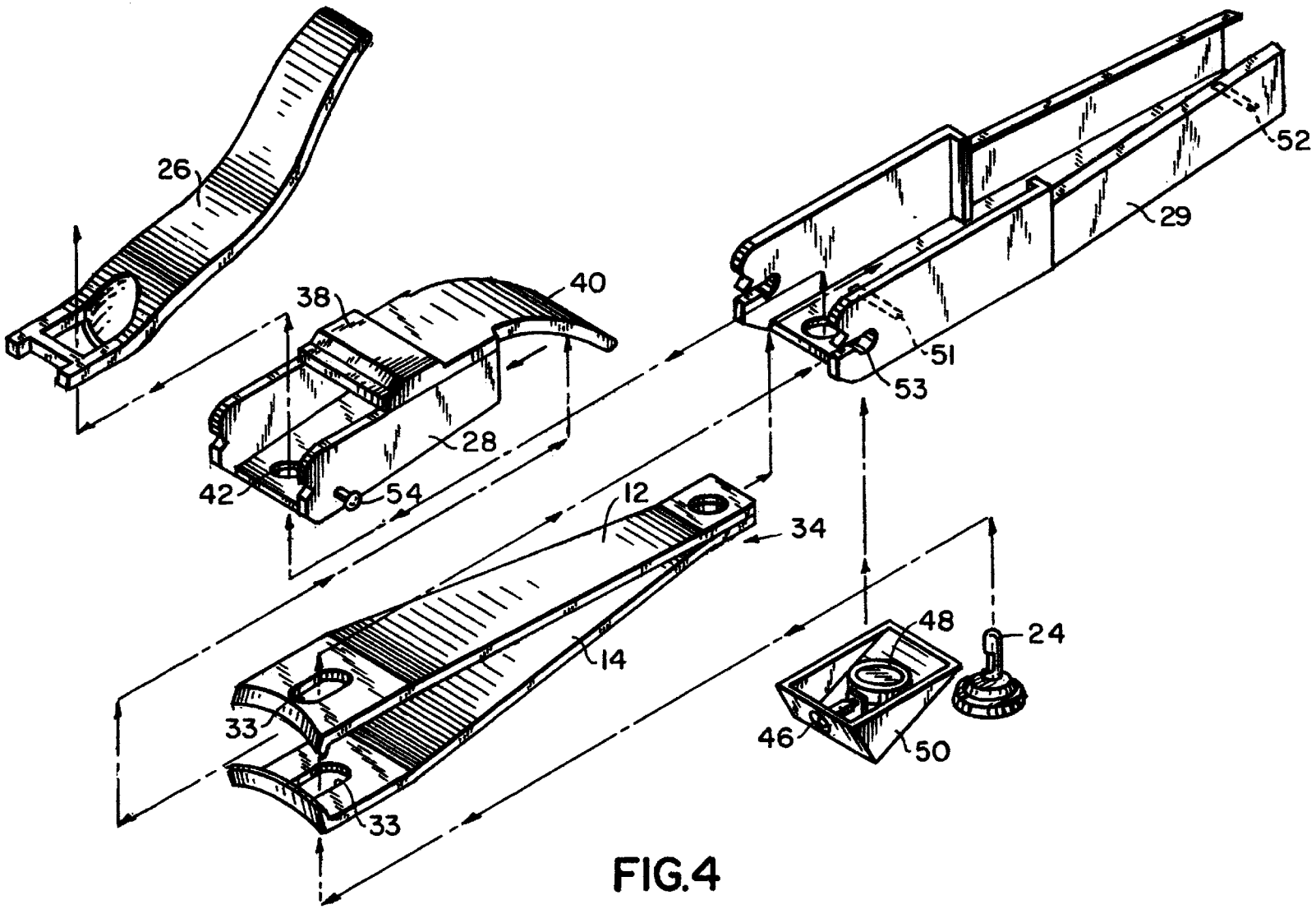
FIG. 4 is an assembly diagram showing how the various elements of the nail clipper and the retaining device are joined together.

FIG. 4 illustrates how all the various members of the nail clipper and the retaining device according to the invention are assembled. The two elongate members 12 and 14 are affixed together at their tail end 34 by a rivet (not shown) and have transverse cutting edges 16 and 18, respectively, at their opposite end forming the jaw 30. The elongate members are preferably made of steel and are biased in the open position (shown in FIG. 4) by their natural spring action.

Pin 24 is passed through openings 33 in the elongate members 12, 14, in the region of the jaw 30. Lever arm 26 is pivotly attached to the free end of the pin 24. Movement of the lever arm about this pivot causes the jaw 30 to open and close.

Before attaching the lever arm 26 to the pin 24, the valve element 28 is slipped over the upper elongate member 12 and brought into alignment so that the pin 24 passes through a hole 42. Thereafter, the housing 26 is slipped over both the upper and lower elongate members and pressed into alignment, so that it is able to pivot about pins 53 which extend from both sides of the valve element.

Once the lever arm 26 is attached to the pin 24, the elongate members 12, 14 and the valve element 28 retained in their respective positions by the pin 24. The housing 26 is held by the valve element by the pivot pins 54 which pass through openings 53 on each side.

As an added, advantageous feature, a small housing 50 may be attached (e.g., glued) to the bottom of the housing 26 to provide a pen light. The housing 50 contains an electric light 46, a battery 48 and an appropriate press-switch with a series electric circuit that connects the light to the battery.

Figure 5A:
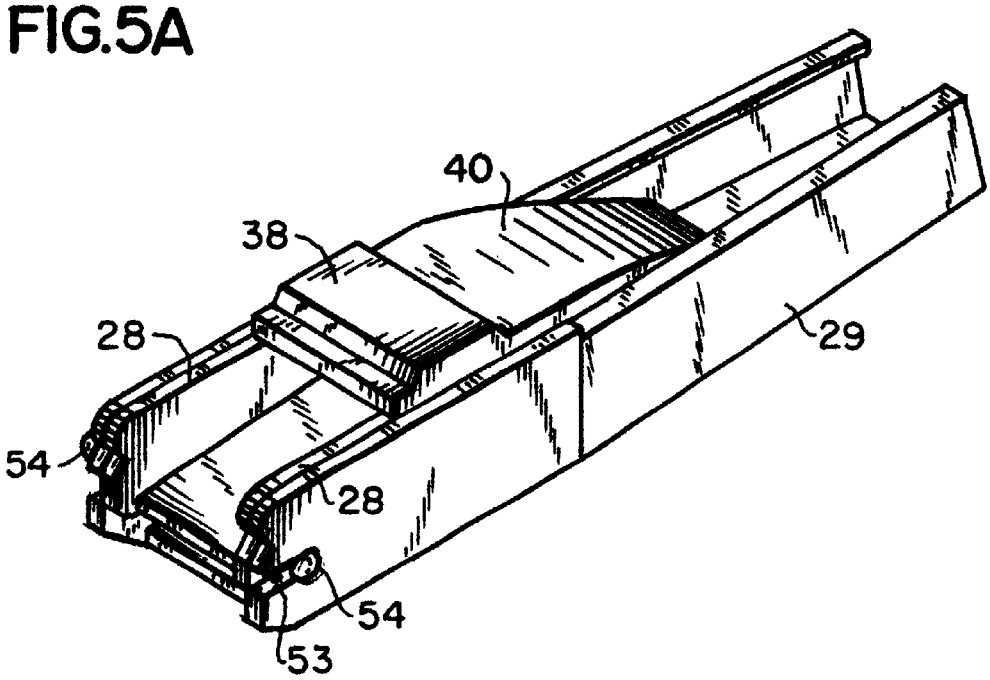
FIGS. 5A and SB are perspective and top views, respectively, of the valve element and housing of the retaining device according to the present invention.
Figure 5B:
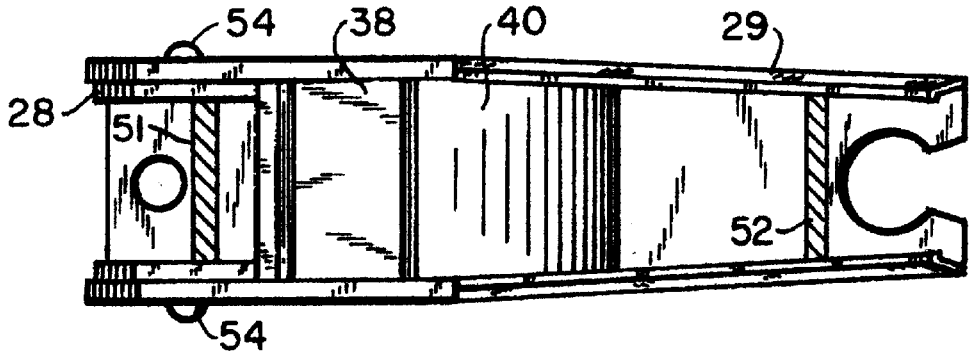
Figure 6A:
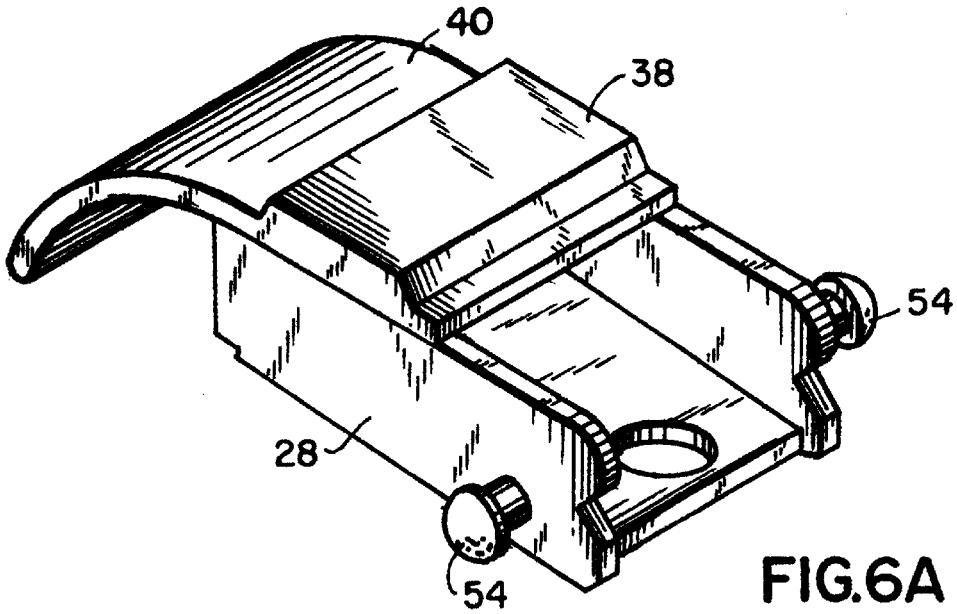
FIGS. 6A, 6B, 6C and 6D are a perspective view, cross-sectional view, top view and end view, respectively, of the valve element of the retaining device according to the present invention.
Figure 6B:
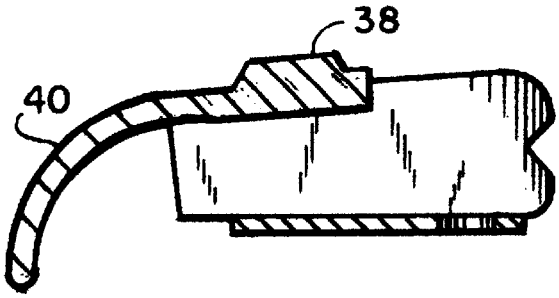
Figure 6C:
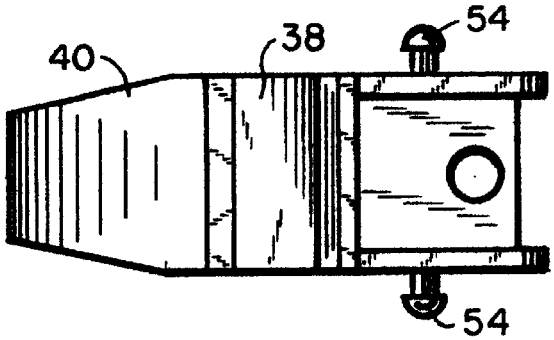
Figure 6D:
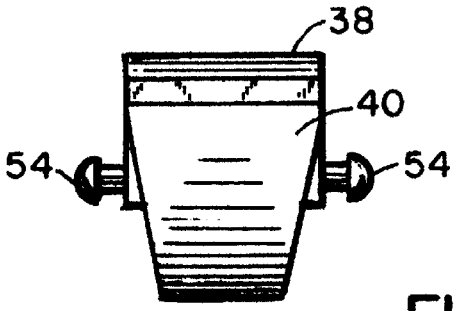

FIGS. 5A and 5B show the housing 26 and the valve element 28 in assembled condition without the nail clipper itself. As may be seen, the housing 26 has a U-shaped front portion for the valve and triangle shape back portion profile which can cover the openings between the opposite lateral edges of the top elongate member so as to retain the nail clippings. Foam seals, 51 and 52, on the front and rear regions of the housing are added to insure that the nail clippings collected in the housing cannot escape. The valve element 28 is shown with its projection 38 and spring like tongue 40.

As is best seen in FIG. 6, the valve element 28 is formed as a rectangular tube shaped element. Like the housing 26, the valve element 28 is preferably made of a clear plastic material.

Figure 7:
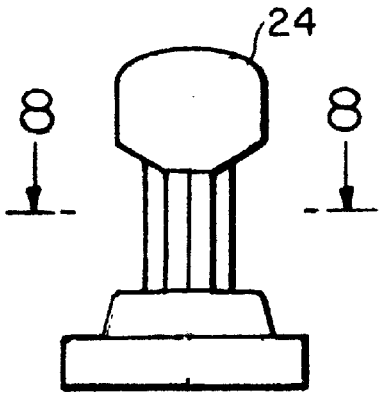
FIG. 7 is a detailed view of a modified pin employed in a nail clipper which uses the retaining device according to the present invention.
Figure 8:
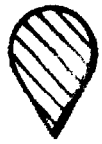
FIG. 8 is a cross-sectional view of the pin of FIG. 7, taken along the line 8—8.

FIGS. 7 and 8 show how the shaft of the pin 24 may be tapered to provide a V-shaped profile. When the pin is oriented such that the apex of the V is pointed toward the jaw 30 of the nail clipper, nail clippings which are cut by the nail clipper can easily move past the pin 24 into the tail region 34 of the elongate members 12, 14.

There has thus been shown and described a novel device for retaining nail clippings which are cut by a nail clipper which fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention, which is to be limited only by the claims which follow.

What is claimed is:

1. A device for retaining nail clippings which are cut by a nail clipper comprising, in combination:

(a) two substantially similar, springlike elongate members, each including a first end having a transverse cutting edge, and a second, opposite end, the second ends of the elongate members being affixed together such that the cutting edges at the first ends are normally spaced apart but can be pressed into cutting engagement with each other against a natural spring bias of the elongate members, said elongate members each having a hole located near said first end, the holes of said two elongate members being in alignment;

(b) a pin arranged to pass through the holes in said elongate members, said pin having a head at one end which is larger than the hole of the adjacent elongate member thus anchoring the pin at said one end and having pivot attachment means at its opposite end; and (c) a lever arm pivotally attached to said opposite end of said pin and operative to swivel between a first position, in which the cutting edges of the elongate members remain spaced apart and a second position in which the elongate members are pressed together and their respective cutting edges are pressed into cutting engagement;

said device comprising, in combination:

(1) a housing adapted to cover openings between the elongate members on opposite, lateral edges thereof, from said first ends to said second ends, thereby forming an enclosed region within the nail clipper; and (2) a valve element, adapted to be arranged between the elongate members, for blocking passage of nail clippings when the lever arm is in said first position and for allowing passage of nail clippings when said lever arm is in said second position, thereby to allow nail clippings to pass to the region between the elongate members adjacent their second ends when the cutting edges are pressed together and such nail clippings are cut from a fingernail or toenail, and thereafter to retain such nail clippings in said region when the cutting edges are spaced apart.

2. The device recited in claim 1, wherein the housing comprises a structure having a U-shaped profile in a front region surrounding the valve element and an open triangle shape profile in a rear region, said structure having an open top portion pressing against the elongate member that is adjacent the lever arm, making a seal therewith and preventing nail clippings from escaping through said top.

3. The device recited in claim 2, wherein said housing has a bottom plate which is provided with a seal in the front and rear regions thereof to prevent clippings that are collected in the housing from escaping from the front and back of the nail clipper.

4. The device recited in claim 2, wherein said housing is pivotally attached to the valve element in said front region, whereby said housing may be pivoted outward away from said elongate members to remove the clippings that are collected therein.

5. The device recited in claim 1, wherein said housing is provided on at least one side surface with at least one of text and graphics.

6. The device recited in claim 1, further comprising an electric light mounted for illuminating a region beyond said first end of said elongate members, a battery, an electric switch and an electric circuit connecting the light, the battery and the switch in series, said light, battery, switch and circuit all being mounted in said housing.

7. The device recited in claim 1, wherein said valve element comprises a tubular-shaped element adapted to surround the elongate element which is adjacent said lever arm, and when in such position to pivot between a closed position, preventing passage of nail clippings, when the lever arm is in said first position and an open position, permitting passage of the nail clippings, when the lever arm is in said second position.

8. The device recited in claim 7, wherein said tubular-shaped element has a rectangular profile.

9. The device recited in claim 7, wherein said valve element further comprises a spring member which extends as a projection from said tubular-shaped element and presses against said elongate element which is adjacent lever arm.

10. The device recited in claim 7, wherein said valve element is made of plastic.

11. The device recited in claim 10, wherein said valve element is made of clear plastic.

12. The device recited in claim 7, further comprising resilient material disposed on at least one of said elongate elements for engaging with said valve element at the edges thereof, thereby to prevent passage of the nail clippings in the region of said edges.

13. The device recited in claim 1, wherein said pin has a V-shaped profile to reduce interference with nail clippings which pass from the first ends to the second ends of said elongate members.

14. The device recited in claim 1, wherein said housing is made of plastic.

15. The device recited in claim 14, wherein said housing is made of clear plastic.

* * * * *